United States Patent [19]

Page

[11] 4,179,330

[45] Dec. 18, 1979

[54] APPARATUS FOR HANDLING WEB MATERIAL, AND METHOD

[76] Inventor: Robert E. Page, R.R. 1, Lake Summerset, Davis, Ill. 61019

[21] Appl. No.: 939,462

[22] Filed: Sep. 5, 1978

[51] Int. Cl.[2] ..... D21F 7/02; D21G 1/02; D21G 9/00

[52] U.S. Cl. ..... 162/113; 162/122; 162/198; 162/199; 162/263; 162/272; 162/281; 162/283; 100/163 A; 100/172; 242/65; 226/7; 226/97

[58] Field of Search ..... 162/113, 122, 197, 198, 162/199, 252, 263, 272, 281, 283, 361; 100/40, 47, 163 A, 176, 172, 173; 242/65, 75.5; 226/7, 97; 26/51; 156/183

[56] References Cited

U.S. PATENT DOCUMENTS

| | | | |
|---|---|---|---|
| 1,626,060 | 4/1927 | Witham, Jr. | 162/263 X |
| 1,676,305 | 7/1928 | Weldon | 226/7 X |
| 3,254,593 | 6/1966 | Beachler | 100/40 X |
| 3,743,199 | 7/1973 | Karr et al. | 242/65 |
| 3,813,019 | 5/1974 | McAnespi et al. | 226/97 |
| 3,846,228 | 11/1974 | Ely et al. | 162/113 X |
| 3,847,390 | 11/1974 | Dixon | 226/97 X |
| 4,087,319 | 5/1978 | Linkletter | 162/113 |

*Primary Examiner*—Richard V. Fisher
*Attorney, Agent, or Firm*—Hill, Van Santen, Steadman, Chiara & Simpson

[57] ABSTRACT

Continuously running web material is transferred from a dryer, or the like, to a proximate calender, or the like, along flutter suppressing foils. The web may be calendered in a nip between a rotary calender roll and a reel drum with which a reel core is in nip relation for winding the web on the core. The calender may comprise a single roll or a plurality of rolls. A split torque arrangement is provided for the reel drum and the reel core. Especially useful for handling creped tissue paper web.

35 Claims, 3 Drawing Figures

APPARATUS FOR HANDLING WEB MATERIAL, AND METHOD

BACKGROUND OF THE INVENTION

This invention relates to the handling of web material from a dryer or the like, to a wind-up reel, and is more particularly directed to new and improved apparatus for and method of attaining high speed operation especially adapted for handling a thin, light weight paper web and in particular continuous creping and winding or reeling of a tissue paper web.

Serious limitations have heretofore been encountered in the speed at which web material such as freshly creped tissue paper could be handled. Because of its light weight and frangible nature, creped tissue paper web has been prone to break in unsupported open draws such as between the creper and calender and between calender and reeling apparatus. Underlying support causes too much friction. Even when travelling unsupported relatively short distances creped web generates such air currents that instability of the web caused by flutter especially at the edges tends to break the web.

SUMMARY OF THE INVENTION

The aim of the present invention is to overcome the problems, disadvantages, drawbacks, inefficiencies, and shortcomings inherent in prior apparatus and methods for producing and reeling thin, light weight web material such as creped tissue paper.

After tissue paper has been creped as by doctoring on a Yankee dryer roll, it is desirable to lightly calender the tissue web for bulk uniformity such that resulting toilet tissue rolls will attain uniform diameter or that boxed tissue will uniformly fill a predetermined size box. According to the present invention running speeds of over 4000 ft. per minute are accommodated by effectively suppressing flutter of the web in a short distance between the creper and as closely as practicable proximate calender.

Reeling of the web is accomplished without any open draw between the calender and the reel. For this a reel drum is adapted to serve as part of the calender apparatus as well as cooperating with successive reel cores in winding or reeling the web on the cores.

Stretching of the web in the reeling process is avoided by spliting the torque between the reel drum and the reel.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which:

IN THE DRAWINGS

DESCRIPTION OF PREFERRED EMBODIMENTS

Figures 1, 2:
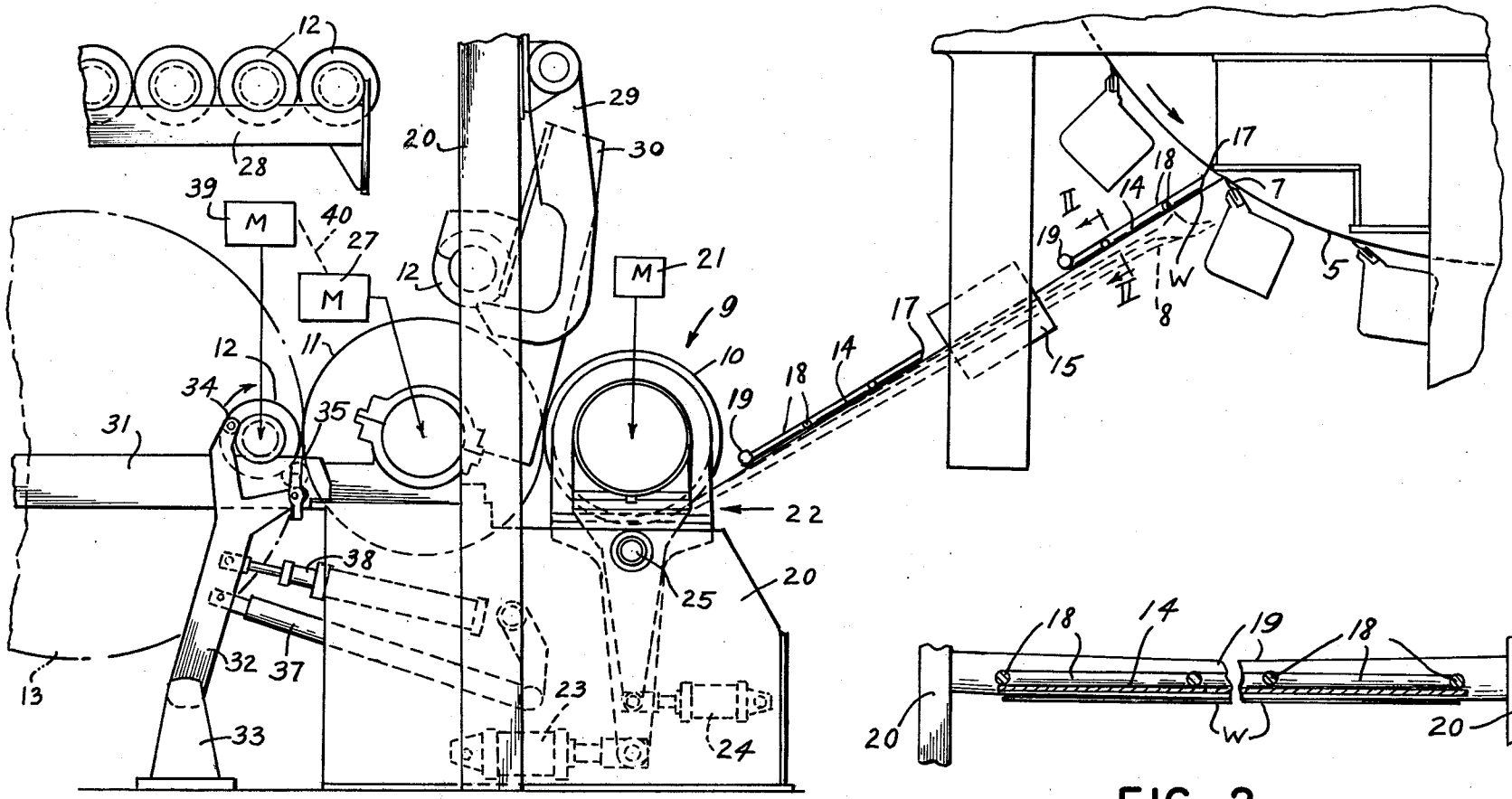
FIG. 1 is a fragmentary schematic side elevational view of apparatus embodying principles of the invention.
FIG. 2 is an enlarged fragmental sectional detail view taken substantially along the line II—II of FIG. 1.

On reference to FIG. 1, a creped tissue paper web W is produced in the usual manner on a so-called Yankee dryer creping roll 5, creping being effected by means of a creping doctor 7. During start-up, an advancing tail terminal is fed into the mouth end of a pneumatic sheet conveyor 8 which may be constructed as and functions in accordance with the disclosure in U.S. Pat. No. 3,847,390 which is incorporated herein by reference. The sheet conveyor 8 may take other forms such as ropes, tapes, vacuum sheaves, or other air transport systems for advancing the web through a calender 9 comprising in this instance a single calender roll 10. From the calender roll 10 the web passes onto a reel drum 11 which is adapted to serve not only as part of the calender but also to advance the web to a reel spool or core 12 on which the web is wound or reeled into a roll 13. By having the calender 9 and reeling mechanism in a compact assembly without any open draw, and by having such assembly located in as close as practical proximity to the creper, substantially increased efficiency and economy are attained. Thereby not only is the space occupied by the creping apparatus substantially minimized, but efficiency of operation is also substantially improved by the relatively short interval between the creping doctor and winding of the creped web, web breaking potential is substantially reduced and control of the creped tissue web quality is improved.

Even though it is necessary to have one open draw of short span in the system between the creping roll 5 and the calender 9, it is within the purview of the present invention to transfer the creped web at high speed from the creping roll 5 to the proximate calender 9 despite the tendency of the creped tissue web to flutter at high speed while traversing an open draw. Heretofore speeds up to about 4,000 ft. per minute have been deemed a practical limit. By suppressing flutter of the web as it travels the open draw between the doctor 7 and the calender roll 10, speeds well above the 4,000 ft. per minute are attainable, according to the present invention with greatly diminished web breaking possibility. To this end, flutter suppressing means comprising one or more suppressor foils 14 are located so that the creped tissue web W travels along the foils in the open draw substantially flutter-free at high speed. Although a single flutter suppressing foil may be employed throughout substantially the entire length of the open draw, in the present instance two of the flutter suppressing foils 14 are shown, with a cross-machine basis weight scanner 15 intervening between the foils 14 for monitoring such factors as basis weight and moisture of the creped web. Such scanners are well known and therefore need not be further described herein.

Each of the flutter suppressing foils 14 preferably comprises a substantially flat plate which extends across the full width of the web W and located at an elevation parallel to and slightly above the path of travel of the web W as it is drawn across the short span between the creper 7 and the calender roll 10. In the preferred relationship, the foil 14 overlies the web W, thereby facilitating removal of broke in the rather minimal possibility of a web break, but if desired, the foil 14 may be located under the web. In any event the operating spacing between the foil 14 and the web W should be adjusted to the minimum practical and just great enough to at least minimize slap and avoid direct frictional engagement between the foil and web. Thereby the foil 14 functions to reduce and stabilize the boundary layer of air between the web sheet and the foil. This effectively suppresses tendency of the web to flutter as is experienced where no control on boundary air is present. At its upstream end, the foil 14 is desirably formed with a lead-in cam surface 17 turned away from the plane of the adjacent web path of travel. Although the plate material of which the foil 14 is made may in and of itself be thoroughly rigidly self-sustaining, thinner gauge material may be employed suitably reinforced such as by means of integral ribs or by means of reinforcing rods 18 fixed to the face of the panel or plate in any suitable manner such as by welding where the plate is metal. In a desirable arrangement the reinforcing rods 18 may be affixed to the foil 14 in a grid pattern extending both longitudinally and transversely of the plate and on the face of the plate opposite to its flutter suppressing face which controls the boundary layer of air along the face of the web W.

In a preferred construction, the flutter suppressing foils 14 are mounted in the associated machine in association with sheet spreader means in a desirable form comprising in each instance a slightly bowed spreader bar 19, (FIGS. 1 and 2). Each of the spreader bars 19 may be supported at its opposite ends on suitable parts of machine frame 20. Thereby the spreader bars 19 are adapted to provide support for the foils 14. Through this arrangement not only is the web W maintained substantially free from flutter while travelling at high speed between the creping doctor 7 and the calender roll 10, but the web is maintained thoroughly spread against any tendency to contract or fold over at the margins. In addition, the spreader bars 19 contribute to maintaining a spaced relation between the high speed travelling web W and the foils 14 so that close operating spacing between the foils and the web is facilitated.

Suitable driving means for the calender roll 10 may comprise a motor 21 drivingly coupled to the roll axle in any desirable manner. It will be understood, of course, that the speed at which the motor 21 drives the roll 10 must be integrated with the speed at which the Yankee dryer creping roll 5 is driven so that the web W will be drawn toward the calender roll 10 substantially taut but without undesirable stretching which might adversely affect the crepe bulk quality of the web. Rotary mounting of the calender roll 10 may be in any preferred fashion, being illustratively mounted on a carriage 22 permitting the roll 10 to be readily adjusted for nip pressure against the reel drum 11 as by means of one or more fluid operated actuators 23 and 24. In the present instance the mounting arrangement shown is of the type which provides for effecting controlled bending of the roll by means of transverse torsion applied to the axle hubs of the roll. On the other hand, the calender roll 10 may be of the internally biased controlled crown type or use the roll offsetting (skewing) technique. In any event, the carriage 22 is mounted on the machine frame 20 on a pivotal mounting 25 facilitating nip pressure adjustment or nip release relative to the cooperating reel drum 11. In the production of creped tissue sheet, a useful function of the calender 9 is to effect controlled crushing of the creped sheet for softness while controlling bulk to a desirable standard.

Mounting of the dual function calender roll and reel drum 11 is in a suitable fashion rotatably on the machine frame 20 and may be on a fixed rotary axis. Rotary driving of the drum 11 may be effected by means of a motor 27 suitably drivingly coupled to the axle of the drum 11. Speed of rotation of the drum 11 will, of course, be correlated to the speed of rotation of the calender roll 10 for efficient cooperation with the calender roll 10 for calender purposes and for proper speed of drawing of the web W into and through the calender 9. Where desirable suitable internal cooling means may be provided for the drum 11 so that it will also serve as a cooling drum for cooling the web W as it travels over the substantial perimeter of the roll 11, because in the short interval between where the web leaves the drying and creping roll 5 and the calender 9, the web is still at a greater temperature than may be desired in the wound web roll 13. On the other hand, conditions may be such that in order to minimize roll distortion and provide uniform nip, controlling of the temperature of the roll 11 may be effected by internal heating.

For substantially automatic threading and winding or reeling of the web, an apparatus substantially similar to that disclosed in U.S. Pat. No. 3,743,199 may be employed, and to the extent necessary the disclosure of that patent is incorporated herein by reference. Successive reel spools or cores 12 are taken from a rack 28 by means of a transfer arm 29 and by associated mechanism 30 transferred in due time into nipping relation to the upper perimeter of the reel drum 11 to pick up the advancing end of the web W during a threading operation, the reel core 12 being driven rotatably by the reel drum 11 to effect winding of the web onto the reel core 12. The thus synchronously driven reel core 12 is deposited on rail means 31 and into the bight of a generally forked secondary arm 32 pivotally mounted at its lower end on a bracket 33 and having at its upper end roller means 34 and 35 engageable with the reel core bearing housing whereby the secondary arm 32 is adapted to control nipping pressure of the reel core 12 relative to the reel drum 11. For this purpose the secondary arm 32 is under the control of a linkage 37 and a fluid operated linear actuator 38. As the diameter of the wound roll 13 increases on the active reel core 12, the control means for the arm 32 is operative to adjust the nip pressure to a safe magnitude.

Means comprising a motor 39 suitably drivingly coupled with the active reel core 12 are provided for driving the reel core in coordinated relation with the reel drum 11, and more particularly in a manner to attain a split torque relationship between the reel drum 11 and the reel core 12 as the diameter of the web reel 13 increases, thereby enabling attainment of a wound web reel of maximum diameter, and more especially larger than according to conventional expedients. For this purpose, the reel drum motor 27 and the reel core motor 39 are operatively coupled by suitable control means 40 so that at the start of a reeling operation the torque relationship may be in a one to one relationship or only slightly differential in favor of the reel core 12 and in any event such as to start web reeling at the desired tension. Then, as the size of the wound web reel diameter increases, the torque differential between the motors 27 and 39 may be gradually increased in favor of the motor 39 to maintain the nip speed of the reel drum 11 and the wound web reel 13 as its size increases. This split torque action with respect to the motors 27 and 39, together with the nip pressure control exerted through the arm 32 assures that the web will be reeled with substantially constant bulk and free from slippage at the nip so that ballooning, crinkling, and the sheet breaks are avoided in the manufacturing process because larger diameter paper roll diameter can be attained and less down time experienced in the machine for stopping and starting the reel being wound. Further, while calendering is desirable for web uniformity, the calendering process does take some of the crepe out of the web and the web is therefore slightly longer after the calender nip than before. Therefore, by splitting the torque between the reel drum and the reel core and effecting progressively greater and proportional torque in the reel core relative lag or overrun movement between the roll being formed and the reel drum is substantially eliminated.

Figure 3:
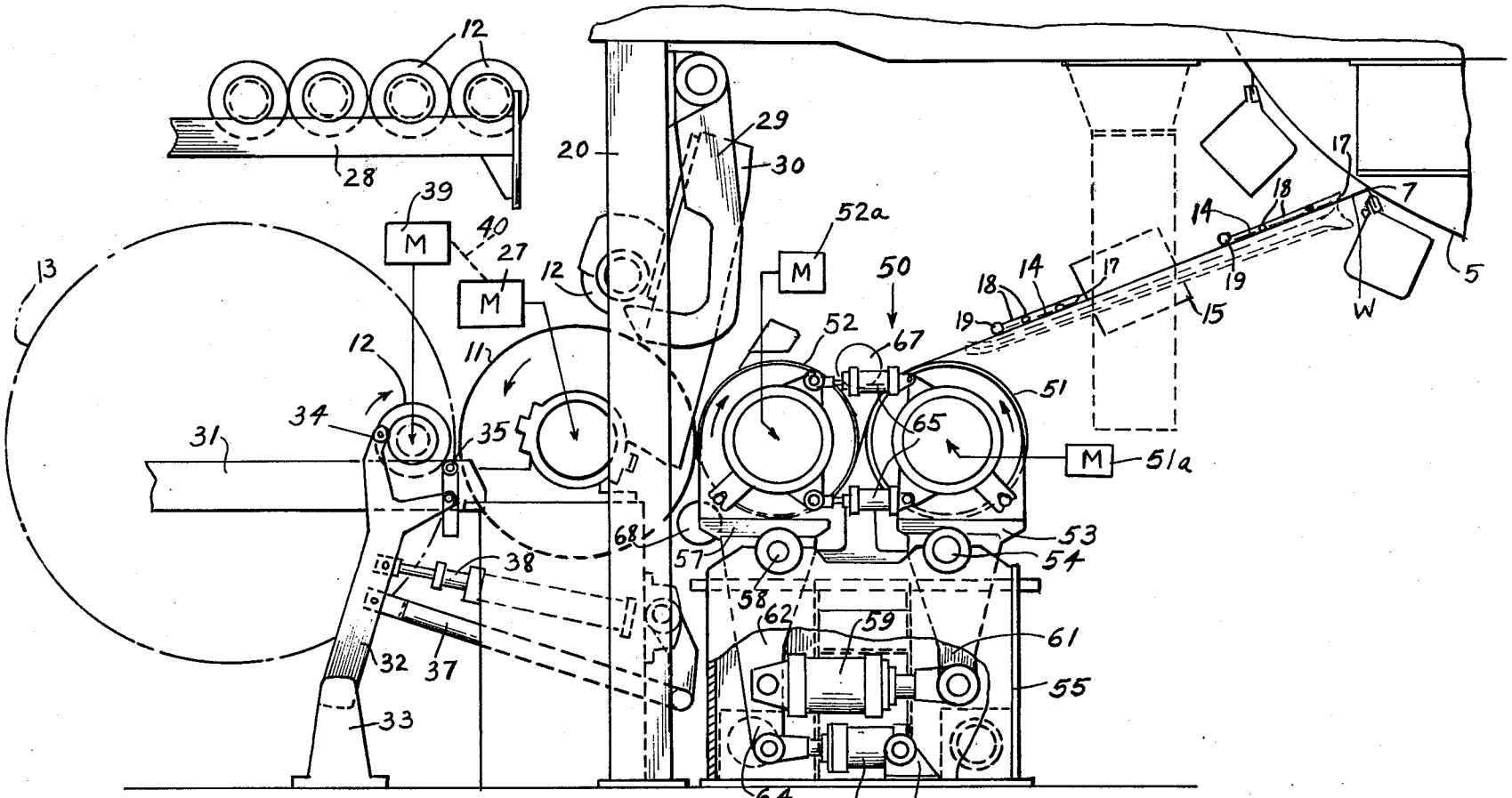
FIG. 3 is a schematic side elevational view of a modified form of the apparatus.

Having reference to FIG. 3, apparatus for handling a continuously running crepe tissue web is disclosed in which the structure and operation are substantially the same as described in connection with FIGS. 1 and 2 except that a calender 50 is provided having a pair of cooperating calender rolls 51 and 52 instead of the single calender roll 10 of FIG. 1. As to all elements in FIG. 3 identified by identical reference numerals to those used in FIGS. 1 and 2, it may be assumed that the structure and function are substantialy the same as described in connection with FIGS. 1 and 2 and therefore description as to those elements will not be repeated. Rotary support for the roll 51 is provided by a carriage 53 supported by means of a pivot 54 on a base frame 55. Rotary support for the roll 52 is provided by a carriage 57 pivotally supported at 58 on the base frame 55. The pivots 54 and 58 are located in suitable horizontally spaced parallel relation to mount the rolls 51 and 52 in calendering nip relation. At the end of the short open draw between the as closely adjacently spaced as practicable roll 5 and calender, the web W is trained into running relation onto the top of the first calender roll 51 and then down into and through the calendering nip between the rolls 51 and 52. From there the web runs on the underside of the second calender roll 52 into and through the calender nip between the roll 52 and the dual calendering and reel drum 11. Means for driving the rolls 51 and 52 may comprise a motor 51*a* and a motor 52*a*, respectively.

Means for adjusting the nip relationship of the rolls 51 and 52, and the nip relationship between the roll 52 and the drum 11 comprise a rectilinear actuator 59 and a rectilinear actuator 60. At one end the actuator 59 is pivotally connected to the lower end of a depending rocker arm 61 rigid with the roll carriage 53. At its opposite end the actuator 59 is pivotally connected to a depending rocker arm 62 rigid with the roll carriage 57. By operation of the actuator 59, the roll carriages 53 and 57 are adapted to be rocked about their pivots to effect opening of the nip between the rolls 51 and 52 as well as thrusting of the rolls 51 and 52 toward one another into controlled calendering nip pressure relationship. On the other hand, the actuator 60 is adapted to adjust the calender rolls 51 and 52 in unison relative to the reel drum 11. For this purpose one end of the actuator 60 is pivotally connected to a bracket 63 fixed to the base frame 55. At its opposite end the actuator 60 is pivotally connected to a downward extension 64 of the rocker arm 62. Through this arrangement the calender rolls 51 and 52 are adapted to be adjusted relative to one another by operation of the actuator 59 without disturbing the adjusted relationship of the calender roll 52 to the reel drum 11. On the other hand, by operation of the actuator 60 adjustment of the calender roll 52 relative to the reel drum 11 is adapted to be effected without disturbing the desired adjustment of the rolls 51 and 52 relative to each other. This affords a wide range of adjustment possibilities depending upon the characteristics desired in the finished creped tissue web W. Sometimes it may be desired to have the web calendered only by the rolls 51 and 52 and in such circumstance the nip between the rolls 52 and 11 may be opened. If it is desired to have calendering effected only by cooperation of the roll 52 with the roll 11, the rolls 51 and 52 may be operated in an open nip relation. During an initial threading operation it may be desirable to have the nips both between the rolls 51 and 52 and between the roll 52 and the roll 11 open.

Although the calender rolls 51 and 52 may be of the internally adjustable controlled crown roll type, they may, as shown, be of the axle biased crown controlled type shown wherein the roll axles or shafts are adapted to be biased by means of fluid actuators 65.

In order to avoid puckering or ballooning of the web ahead of the nip between the calender rolls 51 and 52 due to the high speed of rotation of the rolls 51 and 52, nip barrier means in the form of suction tube 67 has been provided. Such tube extends over the nip and has suction ports attached to a suitable source of vacuum for dust removal. If desired a similar vacuum barrier device 68 may be mounted operatively with respect to the oncoming nip between the second calender roll 52 and the reel drum 11 and which will be effective whether the nip between the rolls 11 and 52 is in calendering pressure relationship or is open. Even when the gap between the rolls 11 and 52 is open, the gap will be very short, i.e., a few thousandths of an inch, so that no significant volume of air can wedge between the web and the drums in the nip area and therefore web flutter or disruption in such area is substantially avoided.

It will be understood that variations and modifications may be effected without departing from the spirit and scope of the novel concepts of this invention.

I claim as my invention:

1. Apparatus for handling a continuously running creped tissue web following creping at a creping roll, comprising:

a calender located proximate said creping roll to receive the web after a short draw span between the creping roll and the calender;

flutter suppressing means along which the web is adapted to travel in said draw span substantially flutter-free at high speed;

said calender including a rotary calender roll;

a rotary reel drum adapted for calendering nip cooperation with said calender roll;

and web winding means including a rotary reel core adapted to be rotatably driven by nipping with said reel drum for winding the web onto the reel core.

2. Apparatus according to claim 1, including means for adjusting the nip pressure of said calender roll with respect to said reel drum.

3. Apparatus according to claim 1, wherein said calender comprises another calender roll having a nip relationship with said first mentioned calender roll for calendering the web in the nip between the calender rolls ahead of calendering of the web between said first mentioned calender roll and said reel drum.

4. Apparatus according to claim 3, including means for adjusting the nip relationship of said calender rolls and for adjusting the nip relationship between said first mentioned roll and said reel drum.

5. Apparatus according to claim 3, including barrier and suction means for avoiding ballooning in the oncoming side of the nip between said calender rolls and for dust removal.

6. Apparatus according to claim 1, including barrier and suction means for and avoiding ballooning in the oncoming side of the nip between said calender roll and said reel drum and for dust removal.

7. Apparatus according to claim 1, including means for driving said reel drum and said reel core in coordinated rotary operation, and adapted to split the torque of the drive by increasing the torque of the reel core relative to the torque of the reel drum substantially proportionate to the increase in diameter of the web roll as the web is reeled on the reel core, whereby to maintain substantially uniform bulk in the wound web.

8. Apparatus according to claim 1, wherein said flutter suppressing means comprises a foil member in closely spaced substantially parallel relation to the web.

9. Apparatus according to claim 8, including sheet stretching bar means operatively related to the travelling web to maintain the web stretched, said flutter suppressing foil being mounted in association with said sheet stretching bar means.

10. Apparatus according to claim 8, wherein said flutter suppressing foil is mounted above said web.

11. Apparatus according to claim 1, including a cross machine basis weight scanner and moisture profile meter device located in operative relation to said web at an intermediate point in said draw span, and said flutter suppressing means comprising a flutter suppressing foil mounted upstream from said device and a second flutter suppressing foil mounted downstream from said device.

12. Apparatus for handling a continuously running creped tissue web following creping at a creping roll, comprising:

a calender located proximate said creping roll to receive the web after a short open draw span between the creping roll and the calender;

said calender including a rotary calender roll;

a combination rotary calender and reel drum adapted for calendering nip cooperation with said calender roll;

and web winding means including a rotary reel core adapted to be rotatably driven by nipping with said reel drum for winding the web onto the reel core.

13. Apparatus according to claim 12, including means for adjusting the nip pressure of said calender roll with respect to said reel drum.

14. Apparatus according to claim 12, wherein said calender comprises another calender roll having a nip relationship with said first mentioned calender roll for calendering the web in the nip between the calender rolls ahead of calendering of the web between said first mentioned calender roll and said reel drum.

15. Apparatus according to claim 14, including means for adjusting the nip relationship of said calender rolls and for adjusting the nip relationship between said first mentioned roll and said reel drum.

16. Apparatus according to claim 14, including means for dust removal in the oncoming side of the nip between said calender rolls.

17. Apparatus according to claim 12, including means for dust removal in the oncoming side of the nip between said calender roll and said reel drum.

18. Apparatus according to claim 12, including means for driving said reel drum and said reel core in coordinated rotary operation, and adapted to split the torque of the drive by increasing the torque of the reel core relative to the torque of the reel drum substantially proportionate to the increase in diameter of the web roll as the web is reeled on the reel core, whereby to maintain substantially uniform bulk in the wound web.

19. Apparatus according to claim 12, including flutter suppressing means located in said short draw span for controlling high speed travel of the web substantially free from flutter.

20. Apparatus for handling a continuously running creped tissue web following creping at a creping roll, comprising:

a calender roll located proximate said creping roll to receive the web after a short free draw between the creping roll and the calender;

a rotary reel drum onto which the web is trained to run from said calender roll;

web winding means including a rotary reel core adapted to be rotatably driven by nipping with said reel drum for winding the web onto the reel core;

and means for rotatably driving said drum and reel core in split torque relation wherein the torque in said reel core is progressively increased substantially proportionate to increase in the diameter of the roll of web as it winds onto the reel core, whereby to maintain substantially uniform bulk in the wound web.

21. Apparatus according to claim 20, comprising means functioning cooperatively with said driving means for progressively adjusting the nip pressure between the roll of the web on the reel core and the reel drum as the size of the roll of web increases to enhance maintaining substantially uniform bulk in the wound web.

22. Apparatus according to claim 20, wherein said calender roll is adapted for calendering nip cooperation with said reel drum, the web running through the nip between said calender roll and said rotary reel drum.

23. Apparatus according to claim 22, wherein said calender comprises a pair of calender rolls in calendering nip relationship, the web running through the nip between said calender rolls and then through the nip between the first mentioned calender roll and said reel drum.

24. Apparatus according to claim 23, including means for adjusting the nip relationship of said calender rolls and for adjusting the nip relationship between said first mentioned roll and said reel drum.

25. Apparatus according to claim 23, including means for dust removal in the oncoming side of the nip between said calender rolls.

26. Apparatus according to claim 22, including means for dust removal in the oncoming side of the nip between said calender roll and said reel drum.

27. A method of handling a continuously running creped tissue web following creping at a creping roll, comprising:

transferring the creped web at high speed a short draw span from the creping roll to a proximate calender including a rotary roll;

suppressing flutter of the web as it travels said draw span at said high speed;

calendering the web in a nip of said calender roll with a rotary reel drum;

and rotatably driving a reel core by nipping the reel core with said reel drum and thereby winding the web onto the reel core.

28. A method according to claim 27, including adjusting the nip pressure of said calender roll with respect to said reel drum for controlling the calendering results.

29. A method according to claim 27, comprising calendering the web between another calender roll and the first mentioned calender roll before calendering the web between the first mentioned calender roll and said reel drum.

30. A method according to claim 29, comprising removing dust in the oncoming side of the nip between said calender rolls.

31. A method according to claim 27, comprising removing dust in the oncoming side of the nip between said calender roll and said reel drum.

32. A method according to claim 27, comprising driving said reel drum and said reel core in coordinated relation, and splitting the torque of the drive by increasing the torque of the reel core relative to the torque of the reel drum substantially proportionate to the increase in diameter of the web roll as the web is reeled on the reel core, whereby to maintain substantially uniform bulk in the wound web.

33. A method according to claim 27, comprising mounting a flutter suppressing foil in closely spaced substantially parallel relation to the web and thereby suppressing flutter of the web.

34. A method of handling a continuously running creped tissue web following creping at a creping roll, comprising:

transferring the creped web at high speed across a short draw from the creping roll to a proximate calender including a rotary roll;

calendering the web in a nip of said calender roll with a rotary reel drum;

and rotatably driving a reel core by nipping the reel core with said reel drum and therby winding the web onto the reel core.

35. A method of handling a continuously running creped tissue web following creping at a creping roll, comprising:

transferring the creped web at high speed across a short draw from the creping roll to a calender roll;

running the web from said calender roll onto a rotary reel drum;

rotatably driving a reel core by nipping the reel core with said reel drum and thereby winding the web onto the reel core;

and splitting the torque relation between the reel drum and the reel core and progressively increasing the torque in said reel core substantially proportionate to increase in the diameter of the roll of web as it winds onto the reel core, whereby to maintain substantially uniform bulk in the wound web.

* * * * *

UNITED STATES PATENT AND TRADEMARK OFFICE

CERTIFICATE OF CORRECTION

PATENT NO. : 4,179,330

DATED : December 18, 1979

INVENTOR(S) : Robert E. Page

It is certified that error appears in the above-identified patent and that said Letters Patent are hereby corrected as shown below:

In the cover sheet, the following should be indicated beneath the names of the inventors:

Assignee: Beloit Corporation,
Beloit, Wisconsin

Signed and Sealed this

*Seventeenth* Day of *June 1980*

[SEAL]

*Attest:*

SIDNEY A. DIAMOND

*Attesting Officer*

*Commissioner of Patents and Trademarks*